US009267670B2

(12) United States Patent
Schlueter

(10) Patent No.: US 9,267,670 B2
(45) Date of Patent: Feb. 23, 2016

(54) ILLUMINATION SYSTEM

(71) Applicant: Schlueter-Systems KG, Iserlohn (DE)

(72) Inventor: Werner Schlueter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 67 days.

(21) Appl. No.: 14/152,020

(22) Filed: Jan. 10, 2014

(65) Prior Publication Data

US 2014/0198491 A1 Jul. 17, 2014

(30) Foreign Application Priority Data

Jan. 11, 2013 (DE) ..... 20 2013 100 140 U

(51) Int. Cl.

| | |
|---|---|
| ***F21V 17/06*** | (2006.01) |
| ***F21V 33/00*** | (2006.01) |
| ***F21V 3/04*** | (2006.01) |
| ***F21V 15/01*** | (2006.01) |
| ***F21K 99/00*** | (2010.01) |
| ***F21V 3/02*** | (2006.01) |
| *F21V 17/16* | (2006.01) |
| *F21Y 101/02* | (2006.01) |

(Continued)

(52) U.S. Cl.

CPC . *F21V 17/06* (2013.01); *F21K 9/30* (2013.01); *F21V 3/02* (2013.01); *F21V 3/0445* (2013.01); *F21V 15/013* (2013.01); *F21V 17/16* (2013.01); *F21V 33/004* (2013.01); *F21V 33/006* (2013.01); *F21S 8/036* (2013.01); *F21V 17/164* (2013.01); *F21Y 2101/02* (2013.01); *F21Y 2103/003* (2013.01)

(58) Field of Classification Search

CPC ..... F21K 9/30; F21V 17/16; F21V 33/006; F21V 15/013; F21V 17/164; F21V 17/06; F21V 33/004; F21V 3/02; F21V 3/0445; F21Y 2103/003; F21Y 2101/02; F21S 8/036

See application file for complete search history.

(56) References Cited

U.S. PATENT DOCUMENTS 1,930,244 A * 10/1933 Lewinsohn et al. ..... 362/129
1,984,355 A 12/1934 Abbott (Continued)

FOREIGN PATENT DOCUMENTS

AT 511 325 A4 11/2012
DE 297 09 378 U1 7/1997

(Continued)

OTHER PUBLICATIONS

German Search Report dated Nov. 6, 2013 in German Application No. 20 2013 100 145.7 with English translation of relevant parts.

(Continued)

*Primary Examiner* — Bao Q Truong
(74) *Attorney, Agent, or Firm* — Collard & Roe, P.C.

(57) ABSTRACT

An illumination system, in particular for illuminating tiled wall protrusions, includes at least one elongate, substantially U-shaped profile that has a base arm and two side arms projecting from the latter and arranged lying opposite one another, the first side arm being made longer than the second arm, at least one illuminant that is fastened or can be fastened within the receiving space defined by the base arm and the two side arms of the profile, and at least one elongate diffusion disc cover fastened or that can be fastened to the profile.

11 Claims, 3 Drawing Sheets

(51) Int. Cl.

| | |
|---|---|
| *F21Y 103/00* | (2006.01) |
| *F21S 8/00* | (2006.01) |

(56) References Cited

U.S. PATENT DOCUMENTS

| | | | | |
|---|---|---|---|---|
| 2,947,093 | A | 8/1960 | Masters | |
| 3,667,177 | A | 6/1972 | Biela | |
| 4,394,714 | A | 7/1983 | Rote | |
| 5,140,506 | A | 8/1992 | Katz | |
| 5,165,780 | A | 11/1992 | Katz | |
| 5,243,799 | A | 9/1993 | Schlueter | |
| 5,336,849 | A | 8/1994 | Whitney | |
| 5,514,834 | A | 5/1996 | Zimmerman | |
| 5,732,747 | A | 3/1998 | Holliday | |
| 5,775,016 | A | 7/1998 | Chien | |
| 6,345,480 | B1 | 2/2002 | Kemper et al. | |
| 6,401,418 | B1 | 6/2002 | Senn et al. | |
| 6,591,575 | B2 | 7/2003 | Benedettini | |
| 6,727,434 | B2 | 4/2004 | Jadaud et al. | |
| 6,745,534 | B2 | 6/2004 | Kornfalt | |
| 6,755,550 | B1 * | 6/2004 | Lackey | 362/147 |
| 6,911,597 | B2 | 6/2005 | Seamans et al. | |
| 6,972,637 | B2 | 12/2005 | Nation | |
| 6,990,776 | B2 | 1/2006 | Berman | |
| 7,060,893 | B1 | 6/2006 | Villi | |
| 7,388,163 | B2 | 6/2008 | VanderVelde et al. | |
| 8,197,105 | B2 * | 6/2012 | Yang | 362/346 |
| 2003/0029125 | A1 | 2/2003 | Salice | |
| 2005/0286247 | A1 | 12/2005 | Peterson | |
| 2006/0185295 | A1 | 8/2006 | Gardner | |
| 2007/0290475 | A1 | 12/2007 | Reitinger | |
| 2008/0066419 | A1 | 3/2008 | Stanchfield et al. | |
| 2011/0058353 | A1 | 3/2011 | Yang | |
| 2011/0183153 | A1 | 7/2011 | Schlueter | |

FOREIGN PATENT DOCUMENTS

| | | | |
|---|---|---|---|
| DE | 297 11 074 | U1 | 7/1998 |
| DE | 202 12 950 | U1 | 12/2003 |
| DE | 20 2007 011 342 | U1 | 11/2007 |
| DE | 20 2009 001 162 | U1 | 4/2009 |
| DE | 10 2008 056 958 | A1 | 5/2010 |
| DE | 20 2010 005 347 | U1 | 8/2010 |
| DE | 20 2011 104 306 | U1 | 10/2011 |
| FR | 2 803 367 | A1 | 7/2001 |
| WO | 2011/151272 | A1 | 12/2011 |
| WO | 2012/056029 | A1 | 5/2012 |

OTHER PUBLICATIONS

German Search Report dated Dec. 19, 2013 in German Application No. 20 2013 100 141.4 with English translation of relevant parts.

* cited by examiner

ILLUMINATION SYSTEM

CROSS REFERENCE TO RELATED APPLICATIONS

Applicant claims priority under 35 U.S.C. §119 of German Application No. 20 2013 100 140.6 filed Jan. 11, 2013, the disclosure of which is incorporated by reference.

BACKGROUND OF THE INVENTION

1. Field of the Invention

The present invention relates to an illumination system that is particularly suitable for illuminating tiled wall protrusions.

2. Description of the Related Art

Illumination systems of the type specified at the start are known in a wide range of configurations in the prior art. For example, a neon tube or an LED strip can be positioned beneath the wall protrusion in order to illuminate the latter.

SUMMARY OF THE INVENTION

On the basis of this prior art it is an object of the present invention to provide an alternative illumination system that is designed optimally for said application.

In order to achieve this object the present invention provides an illumination system of the type specified at the start comprising at least one elongate, substantially U-shaped profile that has a base arm and two side arms projecting from the latter and arranged lying opposite one another, the first side arm being made longer than the second arm, at least one illuminant that is fastened or can be fastened within the receiving space defined by the base arm and the two side arms of the profile, and at least one elongate diffusion disc cover fastened or that can be fastened releaseably to the profile.

One advantage of this illumination system according to the invention is that the longer first side arm can be used as a fastening arm. With the latter the profile can, for example, be fastened to the rear side of the tiles projecting from a wall protrusion such that the first side arm still projects partially under the latter. A tile end profile, for example, that finishes and protects the tile edges can then be positioned on the section of the first side arm which is then accessible. In this way a very elegant appearance of the wall projection and at the same time illumination are made possible.

According to one embodiment of the present invention the profile is an extruded profile with a cross-section that remains the same over the entire length. It is an advantage of extruded profiles that they are easy and inexpensive to produce.

Preferably, the first side arm is at least 1.5 times, and in particular at least twice as long as the second side arm. In this way one achieves the advantage, among other things, that when the first arm is used as a fastening arm, a large fastening surface is available.

Advantageously the outer surface of the first side arm is provided with a fabric or a fleece. This fleece or fabric serves as the adhesive base for an adhesive which is used for fixing the first side arm to a substrate.

According to one configuration of the present invention at least one elongate adhesive strip is provided which is fastened or can be fastened to the outside of the base arm. Correspondingly, the base arm of the profile can be fixed to a substrate by the adhesive strip.

The illuminant is preferably elongate in form, in particular in the form of a strip or a chain with a plurality of LEDs arranged over the latter.

According to one configuration of the present invention the illuminant is fastened or can be fastened to the base arm, in particular using at least one adhesive strip by means of which a compact structure is achieved.

Advantageously the diffusion disc cover is substantially U-shaped and has a base section and two side sections projecting from the latter and arranged lying opposite one another.

According to one version of the present invention the length of the side sections is chosen such that in the correctly arranged state the outer surface of the base section terminates substantially flush with the free end of the second side arm of the profile. In this first version light emitted by the illumination system can correspondingly only pass out of the profile in one direction.

According to a second version the first side section has in the region of its free end a region receding in the direction of the second side section and which is formed such that, in the correctly arranged state, the outer surface of the protruding region of the first side section terminates substantially flush with the outer surface of the second side arm of the profile. In this second version the light can correspondingly also leave the profile in a second direction, as described in more detail by means of the exemplary embodiment described below.

Advantageously, the length of the two side sections is chosen here such that, in the correctly arranged state, the outer surface of the base section terminates substantially flush with the free end of the first side arm of the profile.

At this point it is made clear that an illumination system according to the present invention can have both a diffusion disc cover according to the first version and a diffusion disc cover of the second version.

Advantageously, in order to fasten the diffusion disc cover releaseably to the profile fastening means are provided which are formed integrally with the profile and the diffusion disc cover, by means of which an inexpensive structure with only a few individual components is achieved.

According to one configuration of the present invention the fastening means define a manually releaseable snap-on connection and are provided in particular in the form of protrusions and recesses engaging with one another. In this way a very simple and easily manageable structure of the fastening means is achieved.

The illumination system according to the invention is advantageously used for the rearward illumination of tiled wall protrusions.

In a method for the production of rearward illumination of tiled wall protrusions using an illumination system according to the invention an end profile is positioned on the outer surface of the first side arm of the profile in order to protect the side edges of tiles arranged on the edge and projecting from the wall protrusion.

BRIEF DESCRIPTION OF THE DRAWINGS

Further advantages and features of the present invention become clear from the following description of an illumination system according to an embodiment of the present invention with reference to the attached drawings. These show as follows.

DETAILED DESCRIPTION OF PREFERRED EMBODIMENTS

Figure 1:
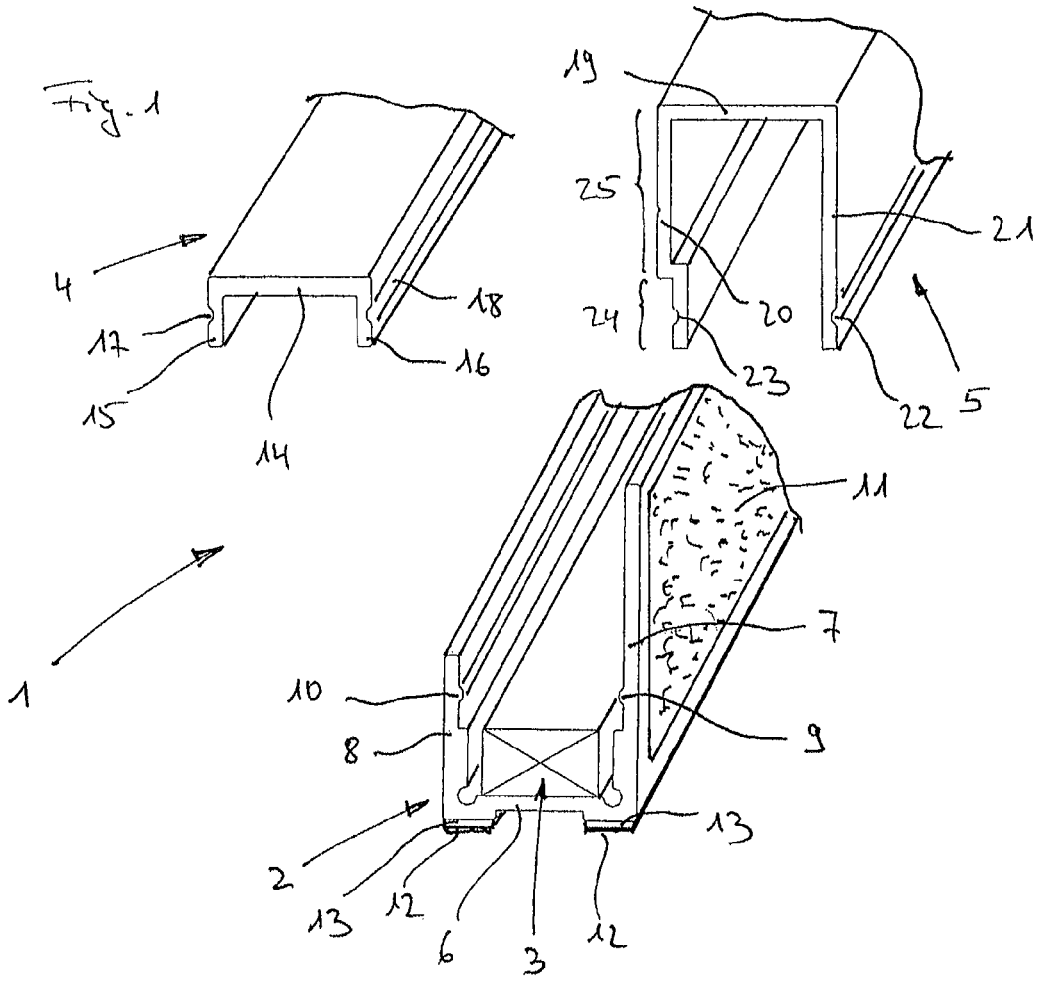
FIG. 1 a perspective view which shows the individual components of an illumination system according to an embodiment of the present invention.

FIG. 1 shows an illumination system 1 according to an embodiment of the present invention. As its main components the illumination system 1 comprises a profile 2, an illuminant 3 and two types of diffusion disc cover 4 and 5.

The profile 2 is an extruded profile that can be produced, for example, from aluminum, stainless steel or plastic. The profile 2 is substantially U-shaped and comprises a base arm 6 and two side arms 7 and 8 projecting substantially perpendicularly from the latter and arranged lying opposite one another, the first side arm 7 being made longer than the second side arm 8 and in this case being approximately twice as long. An inwardly projecting elongate protrusion 9, 10 is respectively positioned on the insides of the side arms 7 and 8. The protrusions 9 and 10 serve to hold diffusion disc cover 4 or diffusion disc cover 5 releaseably, as will be described in more detail below. Fastened to the outside of the first arm 7 is a fleece or fabric 11 which forms an adhesive base for an adhesive when the first side arm 7 is fastened adhesively to a substrate. Arranged on the outside of the base arm 6 are two adhesive strips 13 provided with removeable covers 12 which serve to fasten the base arm 6 to a substrate. Alternatively there can also be provided on the outside of the base arm 6 an undercut recess or a fabric or a fleece so as to enable fixing of the base arm 6 to a substrate using an adhesive, in particular using a tile adhesive. The illuminant 3 is fastened to the inside of the base arm 6. More precisely, the illuminant 3 is stuck to the base arm 6 using an adhesive strip (not visible in FIG. 1).

Figure 2:
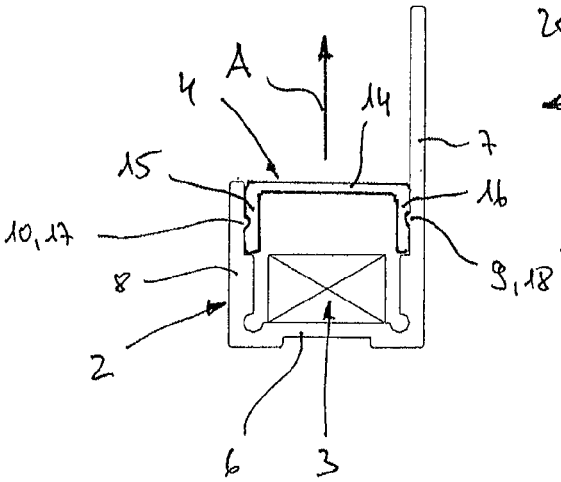
FIG. 2 a side view which shows the illumination system shown in FIG. 1 in a first fitted state.

The diffusion disc cover 4 is produced from transparent plastic and has a substantially U-shaped structure. It comprises a base section 14 and two side sections 15 and 16 projecting at right angles from the latter and arranged lying opposite one another, and which in this case are made with the same length. Each side section 15, 16 is provided with a groove-shaped recess 17, 18 on its outside, in the correctly arranged state the groove-shaped recesses 17 and 18 co-operating with the elongate protrusions 9 and 10 of the profile 2 and defining a manually releaseable snap-on connection, as shown in FIG. 2. The diffusion disc cover 4 can correspondingly be inserted between the side arms 7 and 8 of the profile 2 until the snap-on connection engages. The length of the side sections 15 and 16 and the positions of the groove-shaped recesses 17 and 18 are chosen here such that, in the correctly arranged state, the outer surface of the base section 14 of the diffusion disc cover 4 terminates flush with the free end of the second side arm 8 of the profile 2, as shown in FIG. 2. Correspondingly, light emitted by the illuminant 3 held in the profile 2 can only leave the profile 2 in the direction of arrow A.

Figure 3:
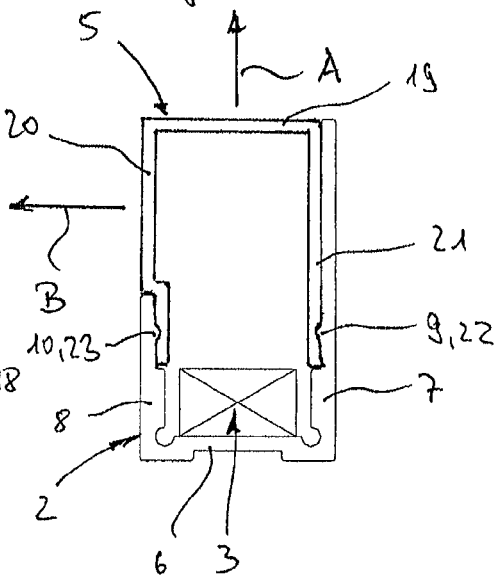
FIG. 3 a side view which shows the profile system illustrated in FIG. 1 in a second fitted state.

The diffusion disc cover 5 is also produced from transparent plastic and comprises a base section 19 and two side sections 20 and 21 projecting at right angles from the latter and arranged lying opposite one another. The side sections 20 and 21 are respectively provided on their outside with a groove-shaped recess 22, 23 which in turn co-operate with the elongate protrusions 9 and 10 of the profile 2 such as to produce a releaseable snap-on connection. The first side section 20 of the diffusion disc cover 5 has in the region of its free end a region 24 receding in the direction of the second side section 21 and which is formed such that, in the correctly arranged state, the outer surface of the correspondingly protruding region 25 of the first side section 20 terminates substantially flush with the outer surface of the second side arm 8 of the profile 2. Moreover, the lengths of the side sections 20 and 21 of the diffusion disc cover 5 and the positions of the groove-shaped recesses 22 and 23 are chosen such that, in the correctly arranged state, the outer surface of the base section 19 of the diffusion disc cover 5 terminates substantially flush with the free end of the first side arm 7 of the profile 2, as shown in FIG. 3. Correspondingly, light emitted by the illuminant 3 can leave the profile 2 in the direction of arrows A and B.

The illuminant 3 is an elongate strip with a plurality of LEDs arranged over the latter. The way the light passes out of the illuminant 3 is chosen such that in the correctly arranged state light is emitted towards the base section 14, 19 of the corresponding diffusion disc cover 4, 5.

FIGS. 2 and 3 show the profile system 1 in the fitted state, according to FIG. 2 the diffusion disc cover 4 and according to FIG. 3 the diffusion disc cover 5 being held on the profile 2, by means of which different light effects are achieved.

Figure 4:
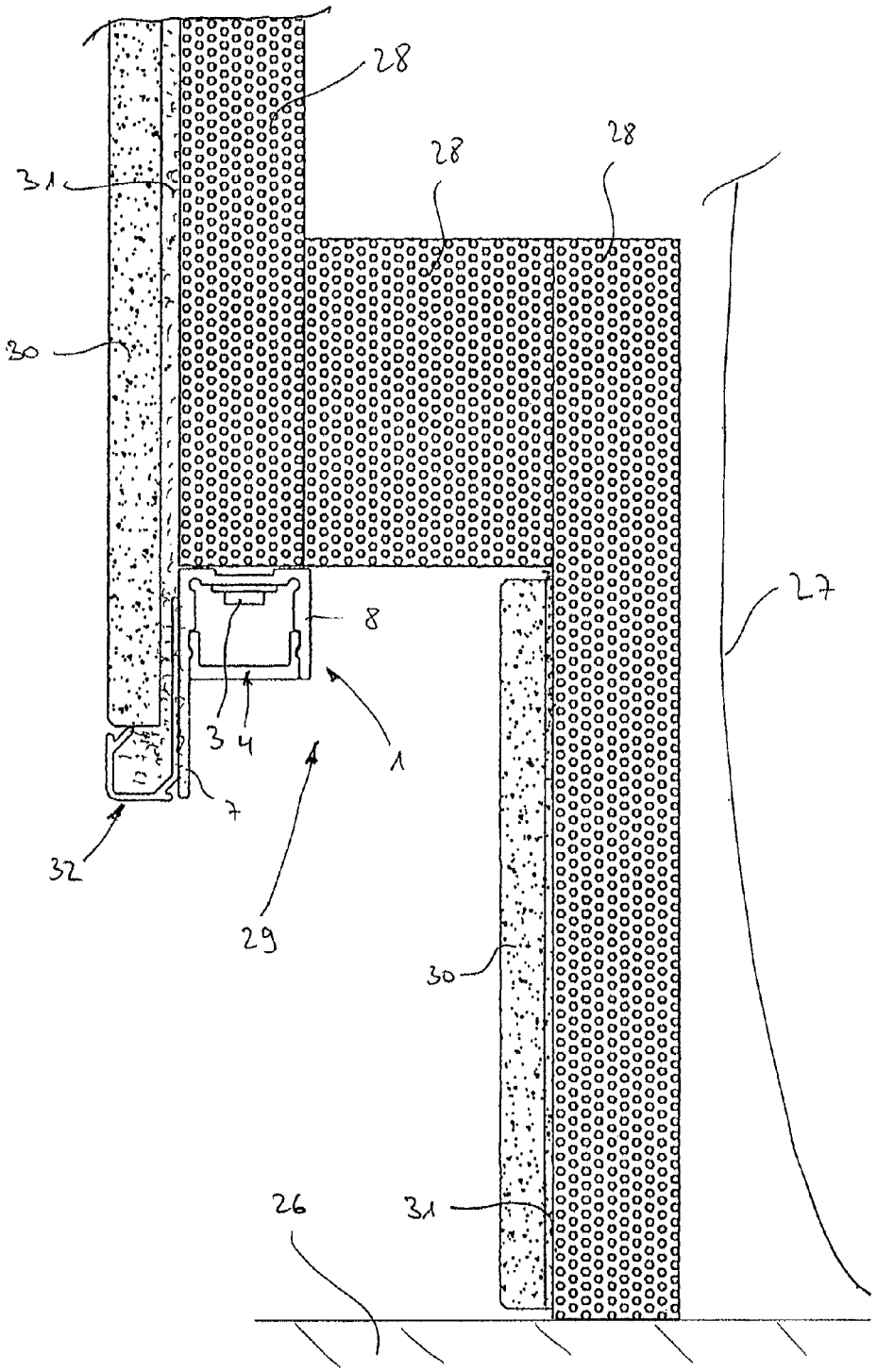
FIG. 4 a partially sectioned side view which shows the fitted illumination system illustrated in FIG. 2 in a state in which the latter is used for the rearward illumination of a tiled wall protrusion.

FIG. 4 shows a partially sectioned side view of an arrangement which serves to clad a bath tub 27 standing on a substrate 26. The bath tub 27 has building boards 28 fitted around it, a wall protrusion 29 being provided, spaced apart from the substrate 26, which serves to give the structure a visually freely floating character. Tiles 30 are stuck to the surfaces of the wall protrusion 29 visible from the outside using tile adhesive 31, the tiles 30 positioned in the edge region of the wall protrusion 29 projecting downwards over the wall protrusion 29. Behind the projecting region of these tiles 30 the illumination system 1 is arranged in the fitted state shown in FIG. 2 such that the base arm 6 is connected to a building board 28 using adhesive strips 13, and that the first side arm 7 of the profile 2 is supported against the tiles 30. Positioned between the first side arm 7 of the profile 2 and the tiles 30 is an end profile 32 which is stuck to the rear side of the first side arm 7 of the profile 2.

If the diffusion disc cover 4 is fastened to the profile 2, as shown in FIG. 4, the region of the substrate 26 located beneath the illumination system 1 is essentially illuminated. If diffusion disc cover 5 is used instead of diffusion disc cover 4, the set-back region of the arrangement is additionally illuminated, by means of which a different appearance is achieved.

Figure 5:
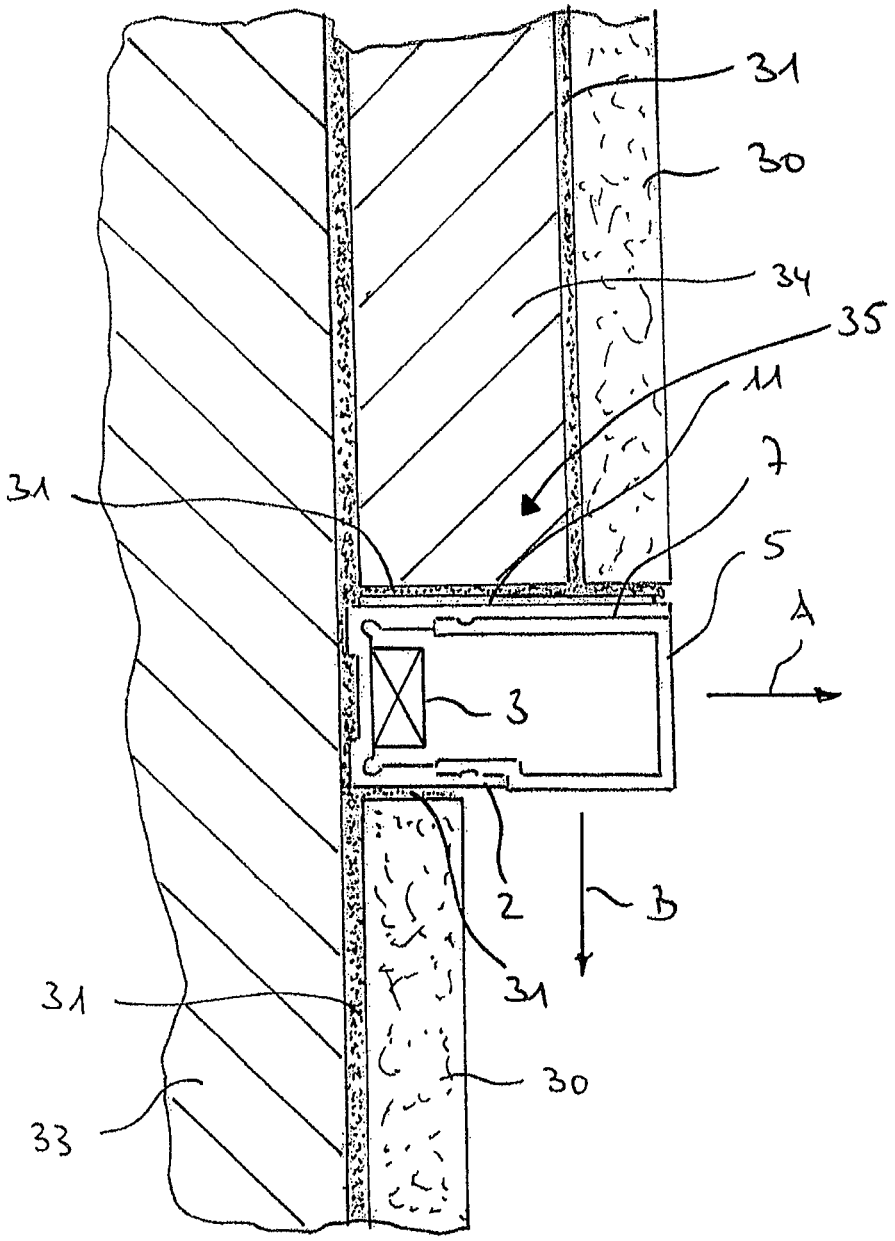
FIG. 5 a partially sectioned side view which shows the fitted illumination system illustrated in FIG. 3 in a state in which the latter is used for the illumination of a tiled wall protrusion.

FIG. 5 shows a partially sectioned side view of an arrangement in which the fitted illumination system shown in FIG. 3 is used with the diffusion disc cover 5 to illuminate a wall protrusion 35. In order to produce the arrangement shown in FIG. 5, in a first step lower rows of tiles 30 are stuck to a wall 33 using a tile adhesive 31. Then, likewise using tile adhesive 31, the profile 2 is placed on the tiles 30 such that the first side arm 7 of the profile 2 points in the upwards direction. Building boards 34 are now stuck onto the wall 33 adjacent to the first side arm 7 of the profile 2 using tile adhesive 31, by means of which said wall protrusion 35 is produced, the fleece or fabric 11 provided on the outside of the first side arm 7 of the profile 2 being stuck to the building board 34. In a further step upper rows of tiles 30 are stuck to the building board 34 using tile adhesive 31, the tiles 30 adjacent to the first side arm 7 of the profile 2 likewise being fixed to the profile 2 by means of the fleece or fabric 11 and the tile adhesive 31. Correspondingly, the profile 2 is integrated securely into the arrangement shown after the tile adhesive 31 has hardened. In a final step the diffusion disc cover 5 is then placed on the profile 2. Correspondingly, light emitted by the illuminant 3 is emitted in the direction of arrows A and B. Alternatively, in the arrangement shown in FIG. 5 the diffusion disc cover 4 can also be used. In this case light emitted by the illuminant 3 is emitted exclusively in the direction of arrow A.

| LIST OF REFERENCE NUMBERS | |
|---|---|
| 1 | illumination system |
| 2 | profile |
| 3 | illuminant |
| 4 | diffusion disc cover |
| 5 | diffusion disc cover |
| 6 | base arm |
| 7 | first side arm |
| 8 | second side arm |
| 9 | elongate protrusion |
| 10 | elongate protrusion |
| 11 | fleece or fabric |
| 12 | cover |
| 13 | adhesive strip |
| 14 | base section |
| 15 | side section |
| 16 | side section |
| 17 | groove-shaped recess |
| 18 | groove-shaped recess |
| 19 | base section |
| 20 | side section |
| 21 | side section |
| 22 | groove-shaped recess |
| 23 | groove-shaped recess |
| 24 | receding region |
| 25 | protruding region |
| 26 | substrate |
| 27 | bath tub |
| 28 | building board |
| 29 | wall protrusion |
| 30 | tile |
| 31 | tile adhesive |
| 32 | end profile |
| 33 | wall |
| 34 | building board |
| 35 | wall protrusion |

What is claimed is:

1. An illumination system, in particular for illuminating tiled wall protrusions, comprising at least one elongate, substantially U-shaped profile that has a base arm and two side arms projecting from the latter and arranged lying opposite one another, the first side arm being made longer than the second arm, at least one illuminant that is fastened or can be fastened within the receiving space defined by the base arm and the two side arms of the profile, and at least one elongate diffusion disc cover fastened or that can be fastened to the profile, wherein the outer surface of the first side arm is provided with a fabric or a fleece.

2. The illumination system according to claim 1, wherein the profile is an extruded profile with a cross-section that remains the same over the entire length.

3. The illumination system according to claim 1, wherein the first side arm is at least 1.5 times, and in particular at least twice as long as the second side arm.

4. The illumination system according to claim 1, wherein at least one elongate adhesive strip is provided which is fastened or can be fastened to the outside of the base arm.

5. The illumination system according to claim 1, wherein the illuminant is elongate in form, in particular in the form of a strip or a chain with a plurality of LEDs arranged over the latter.

6. The illumination system according to claim 1, wherein the illuminant is fastened or can be fastened to the base arm, in particular using at least one adhesive strip.

7. An illumination system, in particular for illuminating tiled wall protrusions, comprising at least one elongate, substantially U-shaped profile that has a base arm and two side arms projecting from the latter and arranged lying opposite one another, the first side arm being made longer than the second arm, at least one illuminant that is fastened or can be fastened within the receiving space defined by the base arm and the two side arms of the profile, and at least one elongate diffusion disc cover fastened or that can be fastened to the profile, wherein the diffusion disc cover is substantially U-shaped and has a base section and two side sections projecting from the latter and arranged lying opposite one another.

8. The illumination system according to claim 7, wherein the length of the side sections, is chosen such that in the correctly arranged state the outer surface of the base section terminates substantially flush with the free end of the second side arm of the profile.

9. The illumination system according to claim 7, wherein the first side section has in the region of its free end a region receding in the direction of the second side section and which is formed such that, in the correctly arranged state, the outer surface of the protruding region of the first side section terminates substantially flush with the outer surface of the second side arm of the profile.

10. The illumination system according to claim 9, wherein the length of the side sections is chosen such that, in the correctly arranged state, the outer surface of the base section terminates substantially flush with the free end of the first side arm of the profile.

11. An illumination system, in particular for illuminating tiled wall protrusions, comprising at least one elongate, substantially U-shaped profile that has a base arm and two side arms projecting from the latter and arranged lying opposite one another, the first side arm being made longer than the second arm, at least one illuminant that is fastened or can be fastened within the receiving space defined by the base arm and the two side arms of the profile, and at least one elongate diffusion disc cover fastened or that can be fastened to the profile, wherein in order to fasten the diffusion disc cover releaseably to the profile, a fastener is provided which is formed integrally with the profile and the diffusion disc cover, and wherein the fastener comprises a manually releaseable snap-on connection in a form of protrusions and recesses engaging with one another.

* * * * *